US011136156B1

(12) United States Patent
Barr

(10) Patent No.: US 11,136,156 B1
(45) Date of Patent: Oct. 5, 2021

(54) RETAINING COLLAPSIBLE TOTES

(71) Applicant: Toshiba Global Commerce Solutions Holdings Corporation, Tokyo (JP)

(72) Inventor: Rodney Barr, Garner, NC (US)

(73) Assignee: Toshiba Global Commerce Solutions, Tokyo (JP)

( * ) Notice: Subject to any disclaimer, the term of this patent is extended or adjusted under 35 U.S.C. 154(b) by 0 days.

(21) Appl. No.: 16/834,519

(22) Filed: Mar. 30, 2020

(51) Int. Cl.
*B65B 67/12* (2006.01)
*A47F 9/04* (2006.01)

(52) U.S. Cl.
CPC ..... *B65B 67/1227* (2013.01); *A47F 9/042* (2013.01)

(58) Field of Classification Search
CPC ..... B65B 67/1227; B65B 67/1233; B65B 67/1211; A47F 9/04; A47F 9/042; A47F 2009/041; B65F 1/1415
USPC ..... 248/95, 97–101
See application file for complete search history.

(56) References Cited

U.S. PATENT DOCUMENTS 2,031,147 A * 2/1936 Doolin ..... A47F 13/085 211/85.15
3,188,031 A * 6/1965 Fournier ..... B60N 3/08 248/95
3,434,686 A * 3/1969 Yoshizaburo ..... G09F 1/10 248/316.3
4,062,604 A * 12/1977 Popper ..... B65B 67/1216 312/211
5,503,355 A * 4/1996 Tan ..... B65B 67/1211 248/101
5,639,051 A * 6/1997 Surbeck ..... B65B 67/1216 248/100
6,325,214 B1 * 12/2001 Smithson ..... A47F 9/042 206/554
6,726,156 B1 4/2004 Scola
8,668,207 B1 * 3/2014 Gilliam ..... G09F 23/06 280/33.992
9,310,018 B2 * 4/2016 Laitila ..... A47F 13/085
10,029,815 B2 * 7/2018 Robinson ..... B65B 67/1266
10,106,284 B2 * 10/2018 Bacallao ..... B65B 67/1233
10,625,895 B2 * 4/2020 Bacallao ..... B65B 67/1233
2009/0045314 A1 * 2/2009 Lien ..... G09F 1/103 248/452
2010/0314507 A1 * 12/2010 Laitila ..... B65B 67/1227 248/97
2013/0092804 A1 * 4/2013 Laitila ..... B65B 67/1233 248/97

(Continued)

OTHER PUBLICATIONS

Jokari, "Baggy Opener," [Accessed Mar. 27, 2020] https://www.jokari.com/products/baggy-opener.

*Primary Examiner* — Ingrid M Weinhold
(74) *Attorney, Agent, or Firm* — Patterson + Sheridan, LLP

(57) ABSTRACT

Aspects described herein include an apparatus for retaining a collapsible tote. The apparatus includes a wall member and one or more engagement members projecting from one or more surfaces of the wall member. The one or more engagement members are arranged and dimensioned to removably engage respective portions of the collapsible tote, suspending the collapsible tote beside a first surface of the one or more surfaces. The wall member is inclined such that, when the collapsible tote is suspended beside the first surface, the collapsible tote is gravitationally urged toward an uncollapsed configuration.

20 Claims, 14 Drawing Sheets

(56) References Cited

U.S. PATENT DOCUMENTS

2014/0138499 A1* 5/2014 Laitila ..... B65B 67/1227
248/97

* cited by examiner

RETAINING COLLAPSIBLE TOTES

BACKGROUND

The present disclosure relates to checkout systems, and more specifically to an apparatus for retaining collapsible totes.

Reusable totes (which are sometimes referred to as "reusable shopping bags", "reusable grocery bags," and so forth) have increased in popularity as an environmentally-friendly alternative to single-use plastic bags. Further, several cities and states have enacted legislation limiting or eliminating the use of single-use plastic bags (sometimes referred to as "t-shirt bags"). However, current bagging stations are primarily focused on dispensing and/or retaining the single-use plastic bags during the bagging process, and are not well-adapted for the structural differences (dimensioning, sidewall strength, weight capacity, etc.) of the reusable totes.

SUMMARY

According to one embodiment, an apparatus for retaining a collapsible tote comprises a wall member and one or more engagement members projecting from one or more surfaces of the wall member. The one or more engagement members are arranged and dimensioned to removably engage respective portions of the collapsible tote, thereby suspending the collapsible tote beside a first surface of the one or more surfaces. The wall member is inclined such that, when the collapsible tote is suspended beside the first surface, the collapsible tote is gravitationally urged toward an uncollapsed configuration.

According to another embodiment, an apparatus for retaining a reusable tote comprises a wall member defining a first surface and an opposing second surface, one or more biased members at the first surface, and one or more hanger members at the second surface. The one or more biased members are arranged and dimensioned to engage an interior surface of a sidewall of the reusable tote, whereby the reusable tote is suspended beside the first surface. The one or more hanger members are arranged and dimensioned to engage a handle of the reusable tote that is connected with the sidewall, whereby the reusable tote is suspended beside the first surface.

BRIEF DESCRIPTION OF THE SEVERAL VIEWS OF THE DRAWINGS

So that the manner in which the above recited aspects are attained and can be understood in detail, a more particular description of embodiments of the disclosure, briefly summarized above, may be had by reference to the appended drawings. It is to be noted, however, that the appended drawings illustrate only typical embodiments of the disclosure and are therefore not to be considered limiting of its scope, for the disclosure may admit to other equally effective embodiments.

DETAILED DESCRIPTION

Aspects of the current disclosure relate to an apparatus for retaining a collapsible tote. The apparatus comprises a wall member and one or more engagement members projecting from one or more surfaces of the wall member. The one or more engagement members are arranged and dimensioned to removably engage respective portions of the collapsible tote, which causes the collapsible tote to be suspended beside a first surface of the one or more surfaces. In some embodiments, the wall member is inclined such that, when the collapsible tote is suspended beside the first surface, the collapsible tote is gravitationally urged toward an uncollapsed configuration. In some embodiments, the one or more engagement members comprise biased member(s) at the first surface that engage an interior surface of a sidewall of the collapsible tote, and/or hanger member(s) at a second surface of the one or more surfaces.

Beneficially, the inclination of the wall member and/or use of the engagement members may ease the bagging process for customers and/or associates. For example, the engagement members permit the collapsible tote to be retained in a suspended configuration, freeing one or both hands of a customer to place items from a shopping cart into the collapsible tote. Further, the inclination of the wall member and/or use of the engagement members may maintain a main storage compartment of the collapsible tote in an open configuration, easing the process of placing items into the collapsible tote.

While features of the tote-retaining apparatus are generally discussed within the context of a shopping environment, such as within a self-checkout system of a retail store, it is contemplated that the techniques disclosed herein may be applied to other environments (some non-limiting examples include libraries, museums, classrooms, hospitals, etc.).

Figure 1A:
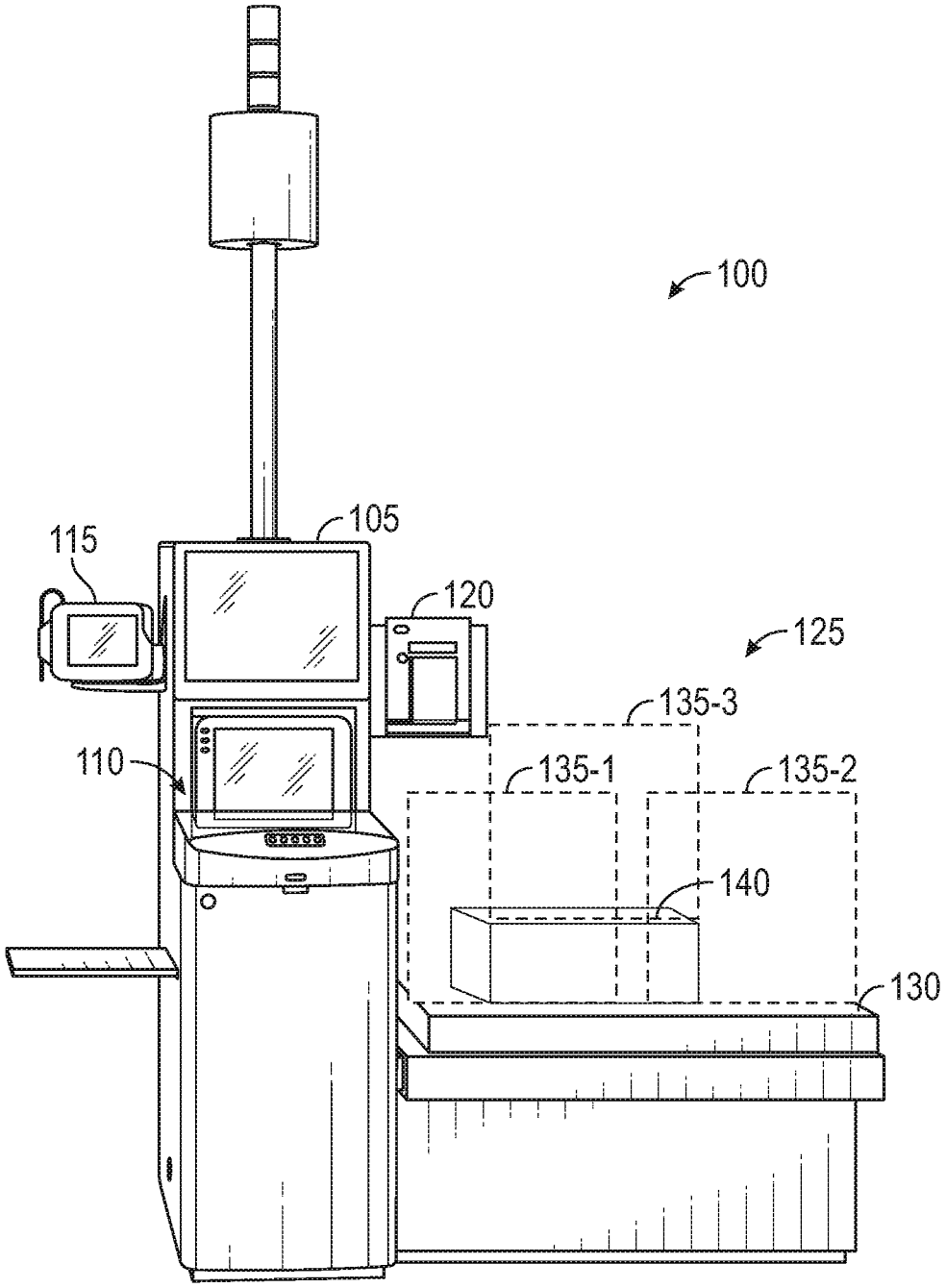
FIG. 1A illustrates an exemplary implementation of a self-checkout system with bagging stations on multiple levels, according to one or more embodiments.

FIG. 1A illustrates an exemplary implementation of a self-checkout system 100 with bagging stations on multiple levels, according to one or more embodiments. The self-checkout system 100 generally has functionality supporting some or all of the stages of a self-checkout transaction, such as scanning items, weighing items, bagging items, and presenting payment.

The self-checkout system 100 comprises a display 105 that presents information viewable by a user (e.g., a customer or an associate) during various stages of a self-checkout transaction. The display 105 is communicatively coupled with one or more computer processors, which may be integrated with the self-checkout system 100 or external to the self-checkout system 100. For example, the one or more computer processors may be included in a computing device integrated with the self-checkout system 100, which may be further networked with other computing devices. In some embodiments, the display 105 comprises a display screen using any suitable display technology, such as a liquid crystal display (LCD), an organic light-emitting diode (OLED) display, and so forth. In some embodiments, the display 105 receives inputs from the user during the self-checkout transaction. For example, the display 105 may be implemented as a touch-sensitive screen using any suitable sensing technology, such as capacitive sensing, resistive sensing, and so forth.

The self-checkout system 100 further comprises an item scanner 110. The item scanner 110 is communicatively coupled with the one or more computer processors, and in conjunction with the one or more computer processors visually identifies items during scanning. For example, the item scanner 110 may detect encoded portions (e.g., a Universal Product Code (UPC), a Quick Response (QR) code) and/or may compare imagery of the item with reference image(s) to identify a type of the item. In some embodiments, the item scanner 110 may further include one or more load cells for measuring weights of items.

The self-checkout system 100 further comprises a payment receiver 115. In some embodiments, the payment receiver 115 comprises a credit card terminal communicatively coupled with the one or more computer processors. Other implementation of the payment receiver 115 are also contemplated. In other embodiments, the self-checkout transaction may be completed without the user presenting payment at the payment receiver 115 (e.g., charged by the one or more computer processors to a customer's account).

The self-checkout system 100 further comprises a printer 120 that prints or otherwise provides tangible items to the user. The printer 120 is communicatively coupled with the one or more computer processors. In some embodiments, the printer 120 generates paper receipts for the self-checkout transaction and/or coupons.

The self-checkout system 100 further comprises a bagging area 125 comprising a plurality of bagging stations 135-1, 135-2, 135-3 (generically, a bagging station 135). As will be discussed in greater detail below, each bagging station 135 includes structure suitable for retaining at least one collapsible tote in a suspended configuration. In some embodiments, each bagging station 135 may also be suitable for dispensing and/or retaining single-use shopping bags.

As shown, the bagging stations 135-1, 135-2 are disposed on a first platform 130, and the bagging station 135-3 is disposed on a raised second platform 140. Use of the first platform 130 and the second platform 140 allows for greater accessibility when bagging items, e.g., without requiring the user having to walk to the other side of the bagging area 125 to access the bagging station 135-3). Other configurations of the bagging stations 135 are also contemplated.

Figure 1B:
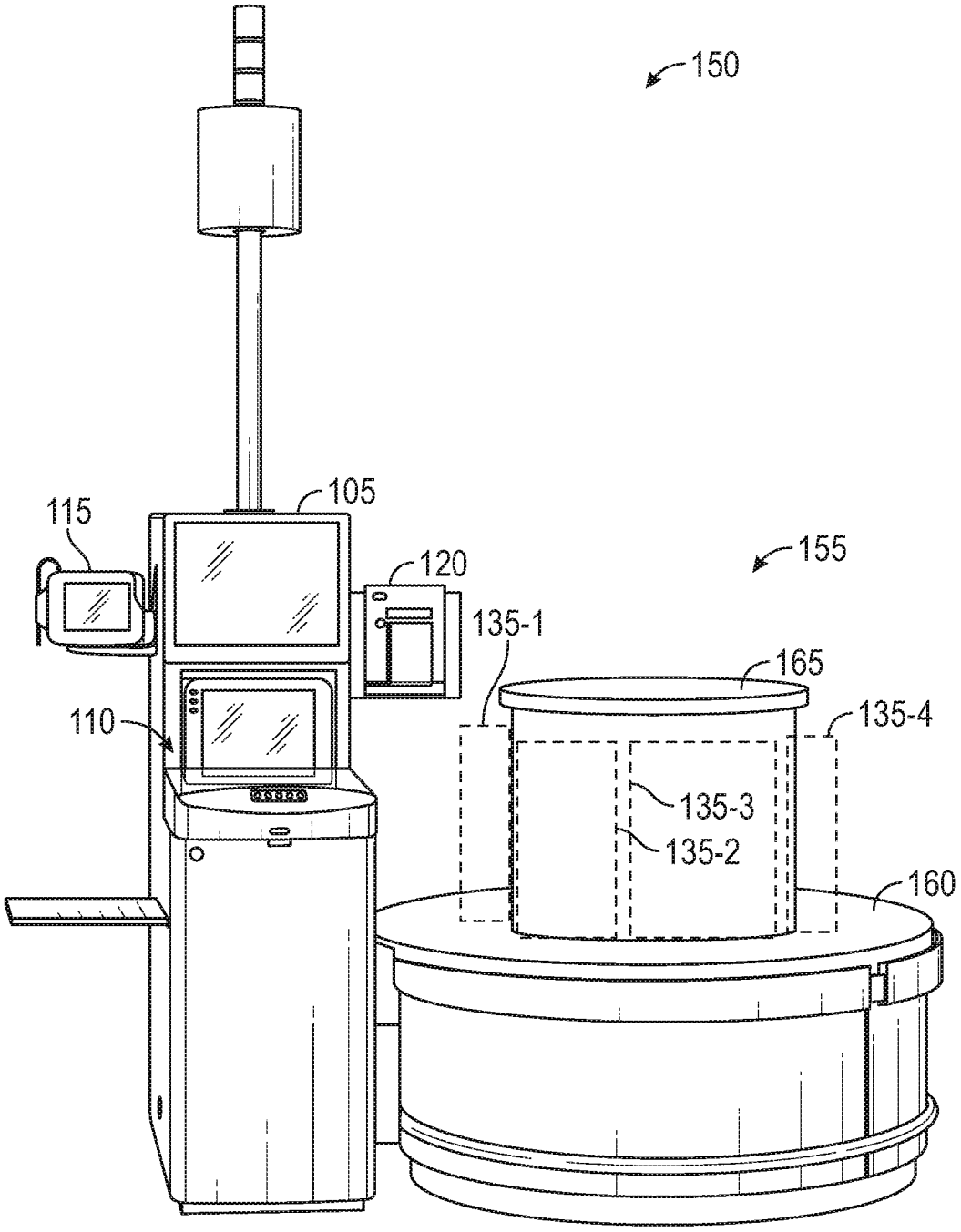
FIG. 1B illustrates an exemplary implementation of a self-checkout system with bagging stations on a carousel, according to one or more embodiments.

FIG. 1B illustrates another exemplary implementation of a self-checkout system 150 with bagging stations 135 on a carousel 165, according to one or more embodiments. The self-checkout system 150 generally includes comparable structure and functionality to the self-checkout system 100.

As shown, the bagging area 155 comprises a plurality of bagging stations 135-1, 135-2, 135-3, 135-4 that are distributed around a circumference of, and attached to, the carousel 165. Although not shown in the current view, the bagging area 155 may include additional bagging stations 135 on the far side of the carousel 165.

The carousel 165 is capable of rotating relative to a base 160. In other embodiments, the carousel 165 and the base 160 are rigidly connected and able to rotate together, e.g., relative to the floor or other surface on which the self-checkout system 150 is disposed. Attaching the bagging stations 135 to the carousel 165 allows for greater accessibility when bagging items, as a user may simply rotate the carousel 165 to access different bagging stations 135.

Figure 2A:
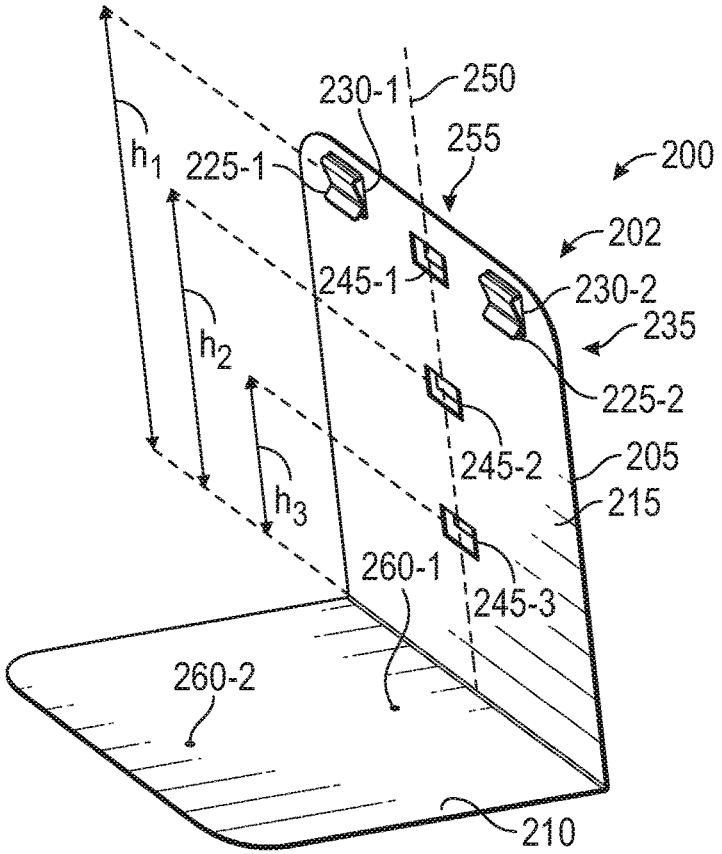
FIGS. 2A-2C are diagrams of an exemplary apparatus having engagement members projecting from multiple surfaces of a wall member, according to one or more embodiments.
Figure 2B:
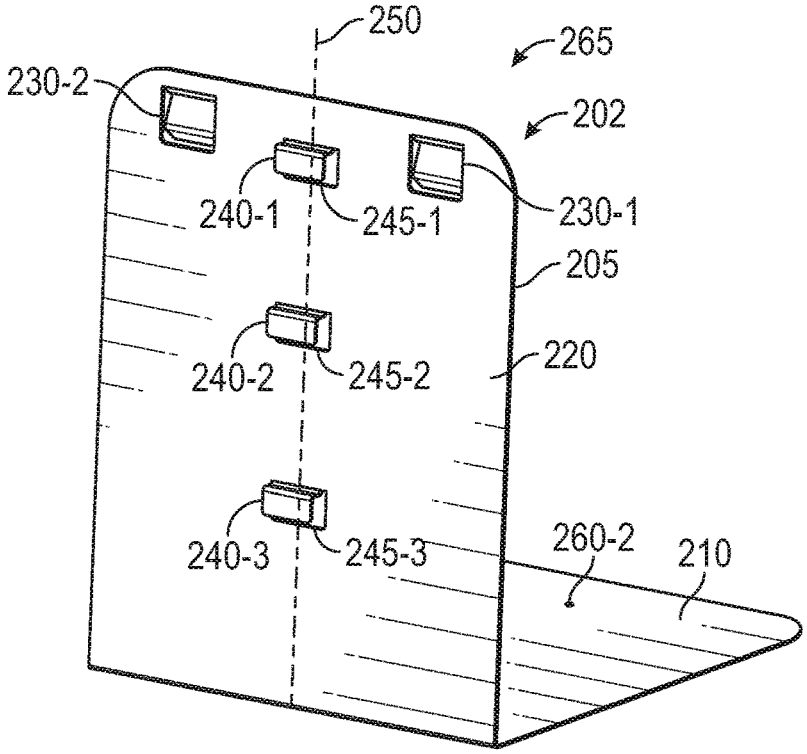
Figure 2C:
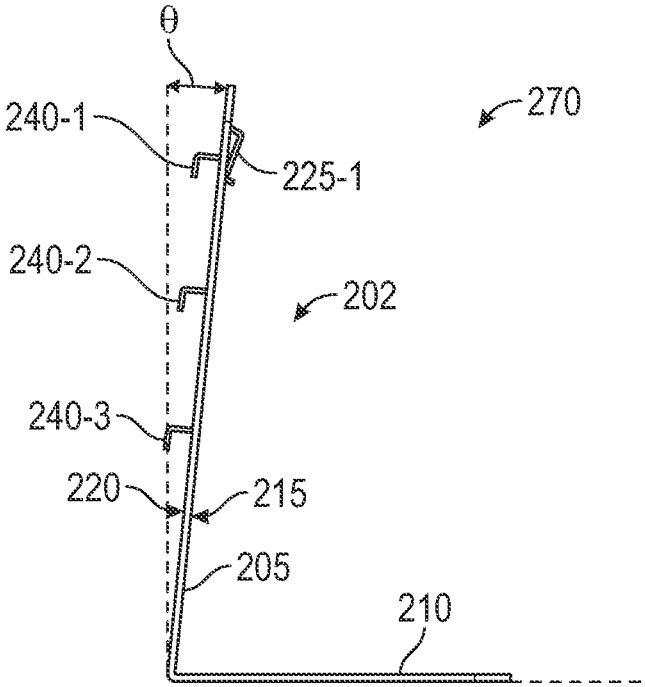

FIGS. 2A-2C are diagrams 200, 265, 270 of an exemplary apparatus (which may be referred to as a "tote-retaining apparatus") having engagement members projecting from multiple surfaces of a wall member, according to one or more embodiments. The features depicted in the diagrams 200, 265, 270 may be used in conjunction with other embodiments described herein. For example, each bagging station 135 of FIGS. 1A and 1B may include a respective instance of the apparatus.

The apparatus comprises a wall member 202. In some embodiments, the wall member 202 defines a wall portion 205 projecting upwardly from a base portion 210. The wall member 202 may be constructed of any suitable material(s) and may have any suitable dimensioning for retaining a collapsible tote. For example, the height of the wall portion 205 may be selected such that the collapsible tote may be suspended (e.g., not resting on the base portion 210 or on another surface beneath the wall portion 205) when engaged with one or more engagement members of the wall member 202, and the material(s) and thickness(es) of the wall member 202 selected to support the weight of the collapsible tote in addition to a predefined weight for items stored therein. For example, the wall member 202 may be dimensioned to support the collapsible tote and at least fifty (50) pounds of items. In some embodiments, the wall member 202 comprises a metal, such as spring steel or aluminum, having suitable yield strength to suspend the collapsible tote (and any items stored therein) without causing a plastic deformation of the wall member 202.

In some embodiments, the wall portion 205 and the base portion 210 are integrally formed (e.g., formed from a single sheet of spring steel). Other techniques for attaching the wall portion 205 and the base portion 210 are also contemplated. For example, the wall portion 205 and the base portion 210 may be welded together or fastened together using a threaded fastener. In alternate implementations of the tote-retaining apparatus, the base portion 210 may be omitted (e.g., the wall portion 205 is attached to other structure of the bagging station).

In some embodiments, the base portion 210 has a horizontal orientation when the tote-retaining apparatus is arranged in a bagging station. In some embodiments, one or more openings 260-1, 260-2 extend through the base portion 210. Each of the openings 260-1, 260-2 is dimensioned to receive a threaded fastener (e.g., a bolt) therethrough. In this way, the wall member 202 may be removably attached (e.g., retrofitted) via the base portion 210 to other structure of the bagging station.

Other techniques for attaching the wall member 202 to the bagging station are also contemplated. In one example, the wall portion 205 may have one or more openings extending therethrough, allowing threaded fasteners to be received therethrough. In another example, the wall portion 205 may be integrated into the bagging station.

The wall portion 205 defines a first surface 215 and a second surface 220 opposing the first surface 215. In some embodiments, the first surface 215 and the second surface 220 are substantially planar, extend parallel to each other, and are coextensive with each other. However, other shapes and relative orientations of the first surface 215 and the second surface 220 (including non-coextensive arrangements) are also contemplated.

In some embodiments, the first surface 215 is inclined with an inclination angle $\Theta$, which tends to gravitationally urge a collapsible tote toward an uncollapsed configuration when the collapsible tote is suspended beside the first surface 215. Generally, the collapsible tote may be configured in a selected one of a collapsed configuration (e.g., where the main storage compartment of the collapsible tote is substantially closed, such as the collapsible tote is folded up) and an uncollapsed configuration (e.g., where the main storage compartment is opened and able to receive items).

In some embodiments, the inclination angle $\Theta$ is between about seven (7) degrees and about thirty (30) degrees less than a vertical orientation. For example, the inclination angle $\Theta$ may be between about ten (10) degrees and about twelve (12) degrees less than the vertical orientation. Other values of the inclination angle $\Theta$ are also contemplated, which may include a vertical orientation of the first surface 215.

In some embodiments, the entire wall portion 205 is inclined with the inclination angle $\Theta$, and each of the first surface 215 and the second surface 215 is inclined with the inclination angle $\Theta$. In other embodiments, differing thicknesses of the wall portion 205 (which may be in combination with an inclination of the wall portion 205) provide the first surface 215 with the inclination angle $\Theta$.

As shown, the first surface 215 is inclined in the direction of extent of the base portion 210 (e.g., forming an acute angle between the base portion 210 and the first surface 215). In other implementations, the first surface 215 may be inclined away from the base portion 210 (e.g., forming an obtuse angle).

The apparatus further comprises one or more engagement members that project from one or more surfaces of the wall member 205. In some embodiments, the one or more engagement members extend from the first surface 215. In some embodiments, the one or more engagement members extend from the second surface 220. In some embodiments, the one or more engagement members extend from each of the first surface 215 and the second surface 220.

The one or more engagement members are arranged and dimensioned to removably engage respective portions of the collapsible tote, which thereby suspends the collapsible tote beside the first surface 215. As mentioned above, the first surface 215 (or the wall portion 205) may be inclined such that, when the collapsible tote is suspended beside the first surface 215, the collapsible tote is gravitationally urged toward an uncollapsed configuration.

In some embodiments, the one or more engagement members comprise one or more biased members 225-1, 225-2 at the first surface 215 and/or one or more hanger members 240-1, 240-2, 240-3. The one or more biased members 225-1, 225-2 are arranged and dimensioned to engage an interior surface of a sidewall of the collapsible tote. The biasing of the one or more biased members 225-1, 225-2 may be provided by forming the one or more biased members 225-1, 225-2 of a resilient material (e.g., spring steel), and/or by spring loading the one or more biased members 225-1, 225-2.

In some embodiments, the one or more biased members 225-1, 225-2 are integrally formed with the wall member 202. For example, the one or more biased members 225-1, 225-2 may be formed from a same, single sheet of metal as the wall member 202, such that cutting and shaping portions of the sheet to form the one or more biased members 225-1, 225-2 causes openings 230-1, 230-2 to be defined in the wall member 202. The one or more biased members 225-1, 225-2 may be shaped to extend partly into the openings 230-1, 230-2. In other embodiments, the one or more biased members 225-1, 225-2 may be attached to the wall member 202 using any suitable means (e.g., welded, fastened together using a threaded fastener).

In some embodiments, and as shown in the diagram 200, 265, 270, the one or more biased members 225-1, 225-2 are implemented as a plurality of clips arranged as one or more pairs 235 of clips. Each pair 235 of the one or more pairs 235 of clips has a respective height $h_1$ along the first surface 215. Although a single pair 235 is shown, other implementations may have multiple pairs 235 of clips arranged at different heights. The multiple pairs 235 may be beneficial to suspend different types of collapsible totes with different heights, to suspend the collapsible tote at a desired height, and so forth. In some embodiments, each pair 235 of the one or more pairs 235 of clips is distributed on opposing sides of a midline 250 of the wall member 202 (e.g., symmetrically arranged relative to the midline 250).

The clips of each pair 235 engage the interior surface of the sidewall when the sidewall is slid between the first surface 215 and the clips. In some embodiments, the clips of each pair 235 engage the interior surface of the sidewall when the sidewall is slid upwardly (e.g., along the first surface 215). In other embodiments, the sidewall may be slid in a different direction to engage the clips of each pair 235. For example, in an alternate implementation the sidewall may be slid downwardly, and the clips of each pair 235 pass through corresponding openings in the sidewall (e.g., grommets) before engaging the sidewall.

The one or more hanger members 240-1, 240-2, 240-3 are arranged and dimensioned to engage a handle of the collapsible tote. In some embodiments, the one or more hanger members 240-1, 240-2, 240-3 are integrally formed with the wall member 202. For example, the one or more hanger members 240-1, 240-2, 240-3 may be formed from a same, single sheet of metal as the wall member 202, such that cutting and shaping portions of the sheet to form the one or more hanger members 240-1, 240-2, 240-3 causes openings 245-1, 245-2, 245-3 to be defined in the wall member 202. In other embodiments, the one or more hanger members 240-1, 240-2, 240-3 may be attached to the wall member 202 using any suitable means (e.g., welded, fastened together using a threaded fastener).

In some embodiments, the one or more hanger members 240-1, 240-2, 240-3 comprise hooks, knobs, posts, and/or tabs that project outwardly from the second surface 220. As shown, the one or more hanger members 240-1, 240-2, 240-3 comprise a plurality of first hooks having downward-facing throats and distributed along a height of the wall member. As shown, the plurality of first hooks are arranged along the midline 250 as a single column 255, and each of the first hooks has a respective height $h_1$, $h_2$, $h_3$. The one or more hanger members 240-1, 240-2, 240-3 may be beneficial to suspend different types of collapsible totes with different heights and/or different handle lengths, to suspend the collapsible tote at a desired height, and so forth.

In some embodiments, when the handle of the collapsible tote is engaged by the one or more hanger members 240-1, 240-2, 240-3, the handle extends over a top of the wall member 202 to suspend the collapsible tote beside the first surface 215. In other implementations, the handle may extend around the sides of the wall member 202, may pass through an opening extending through the wall member 202, etc. to suspend the collapsible tote beside the first surface 215.

As will be discussed below with respect to FIG. 7, the one or more hanger members 240-1, 240-2, 240-3 may further comprise a plurality of second hooks arranged as one or more pairs of second hooks. Each pair of the one or more pairs of second hooks may be distributed on opposing sides of the midline 250 with a respective height along the second surface 220, and the second hooks of each pair have laterally-facing throats. In this way, the handle of the collapsible tote may engage with one or more first hooks (with downward-facing throats) and/or one or more second hooks (with laterally-facing throats) when the collapsible tote is suspended beside the first surface 215.

Figure 3A:
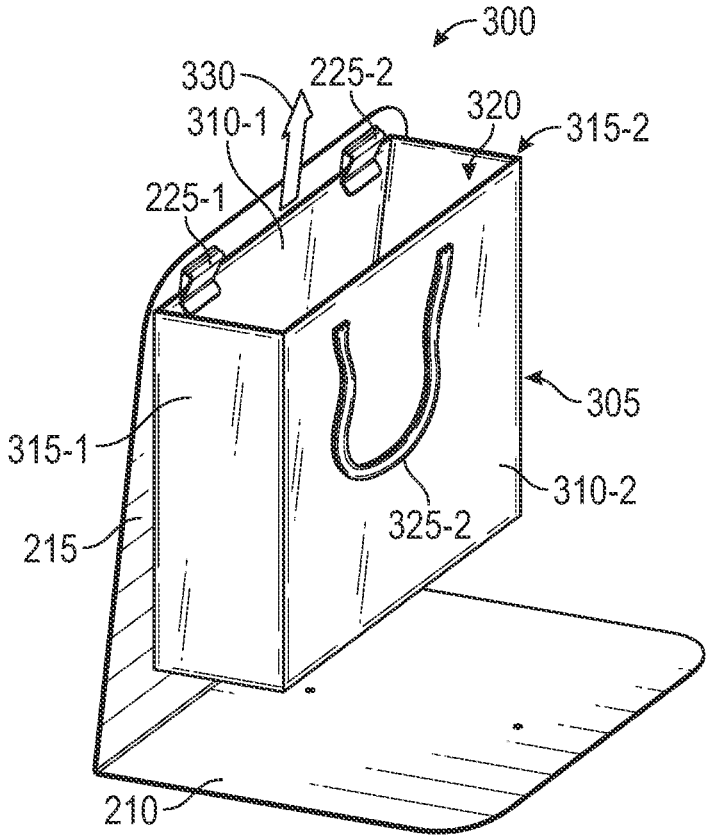
FIGS. 3A and 3B illustrate engaging a collapsible tote with biased members to suspend the collapsible tote, according to one or more embodiments.
Figure 3B:
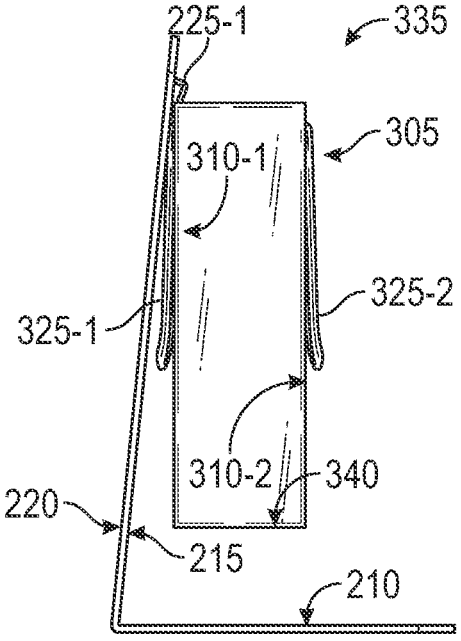

FIGS. 3A and 3B illustrate engaging a collapsible tote 305 with biased members 225-1, 225-2 to suspend the collapsible tote 305, according to one or more embodiments. More specifically, diagrams 300, 335 illustrate one mode of engaging the collapsible tote 305 with the tote-retaining apparatus depicted in FIG. 2.

The diagram 300 provides a perspective view of the tote-retaining apparatus, and the diagram 335 provides a side view of the tote-retaining apparatus. The collapsible tote 305 comprises a first pair of opposing sidewalls 310-1, 310-2, which are connected to a second pair of opposing sidewalls 315-1, 315-2 and to a base 340. The connection of the sidewalls 310-1, 310-2, 315-1, 315-2 and the base 340 defines a main storage compartment 320 of the collapsible tote 305. The collapsible tote 305 further comprises handles 325-1, 325-2 that are attached to respective sidewalls 310-1, 310-2.

The sidewalls 310-1, 310-2, 315-1, 315-2, the base 340, and the handles 325-1, 325-2 may be formed of any suitable material(s). Some non-limiting examples of suitable materials include fabric (e.g., canvas), woven natural fibers (e.g., calico, jute) or synthetic fibers, and plastics that are more durable than single-use plastic bags (e.g., non-woven polypropylene when compared to high-density polyethylene).

In some embodiments, the sidewalls 310-1, 310-2, 315-1, 315-2 and the base 340 are formed of a same material. The handles 325-1, 325-2 may be formed of the same material as the sidewalls 310-1, 310-2, 315-1, 315-2 and the base 340, or may be formed of different material(s). The handles 325-1, 325-2 may be connected with the sidewalls 310-1, 310-2 using any suitable techniques. In one non-limiting example, the sidewalls 310-1, 310-2, 315-1, 315-2 and the base 340 are formed of canvas, and the handles 325-1, 325-2 are formed of leather and stitched to the handles 325-1, 325-2.

In some embodiments, the sidewalls 310-1, 310-2, 315-1, 315-2 may include one or more features that encourage the collapsible tote 305 into a collapsed configuration (e.g., where the main storage compartment 320 is substantially closed), such as when the collapsible tote 305 is compactly folded. For example, some or all of the sidewalls 310-1, 310-2, 315-1, 315-2 may be creased, allowing the collapsible tote 305 to be preferentially collapsed at the creases. The collapsible tote 305 may further comprise a closing mechanism (e.g., hook-and-loop, snaps) capable of maintaining the collapsible tote 305 in the collapsed configuration.

As shown, the one or more biased members 225-1, 225-2 are implemented as a plurality of clips. The clips engage the interior surface of the sidewall 310-1 when the sidewall 310-1 is slid upwardly (i.e., in the direction of arrow 330) between the first surface 215 and the clips. Engaging the sidewall 310 causes the collapsible tote 305 to be suspended beside the first surface 215. As mentioned above, when the collapsible tote 305 is suspended beside the first surface 215, the collapsible tote 305 may be gravitationally urged toward an uncollapsed configuration. In the uncollapsed configuration, the main storage compartment 320 is able to receive items therein. The collapsible tote 305 may be detached from the tote-retaining apparatus by sliding the sidewall 310-1 in a downward direction with sufficient force to disengage the sidewall 310-1 from the clips.

Figure 4A:
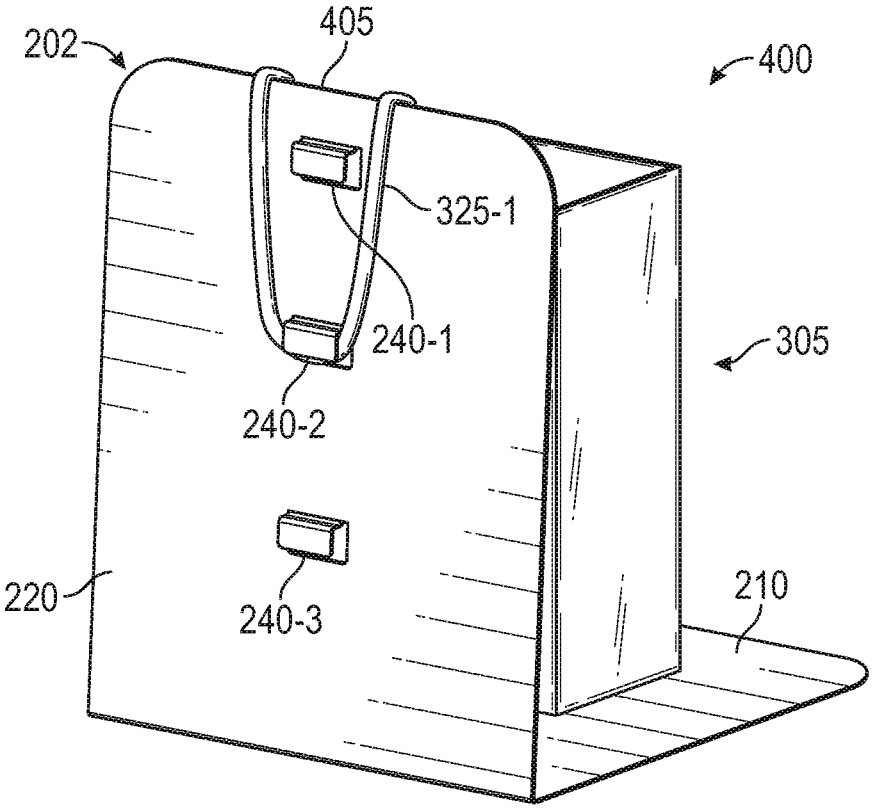
FIGS. 4A and 4B illustrate engaging a collapsible tote with hanger members to suspend the collapsible tote, according to one or more embodiments.
Figure 4B:
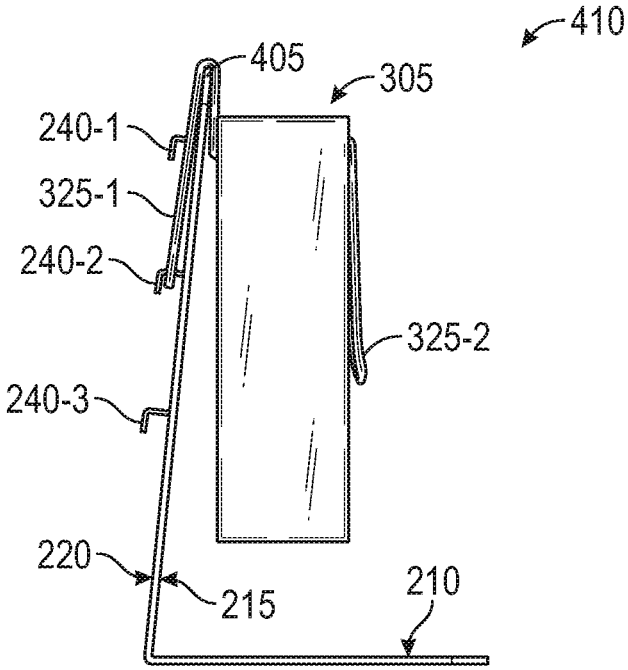

FIGS. 4A and 4B illustrate engaging the collapsible tote 305 with hanger members 240-1, 240-2, 240-3 to suspend the collapsible tote 305, according to one or more embodiments. More specifically, diagrams 400, 410 illustrate another mode of engaging the collapsible tote 305 with the tote-retaining apparatus depicted in FIG. 2.

The diagram 400 provides a perspective view of the tote-retaining apparatus, and the diagram 410 provides a side view of the tote-retaining apparatus. The handle 325-1 extends over a top 405 of the wall member 202 and is engaged with the hanger member 240-2 (e.g., a hook with a downward-facing throat) to thereby suspend the collapsible tote 305 beside the first surface 215. The handle 325-1 may alternately be engaged with the hanger member 240-3 to raise the collapsible tote 305, or with the hanger member 240-1 to lower the collapsible tote 305.

As mentioned above, when the collapsible tote 305 is suspended beside the first surface 215, the collapsible tote 305 may be gravitationally urged toward an uncollapsed configuration. The collapsible tote 305 may be detached from the tote-retaining apparatus by sliding the handle 325-1 in a downward direction with sufficient force to disengage the handle 325-1 from the hanger member 240-2.

Figure 5:
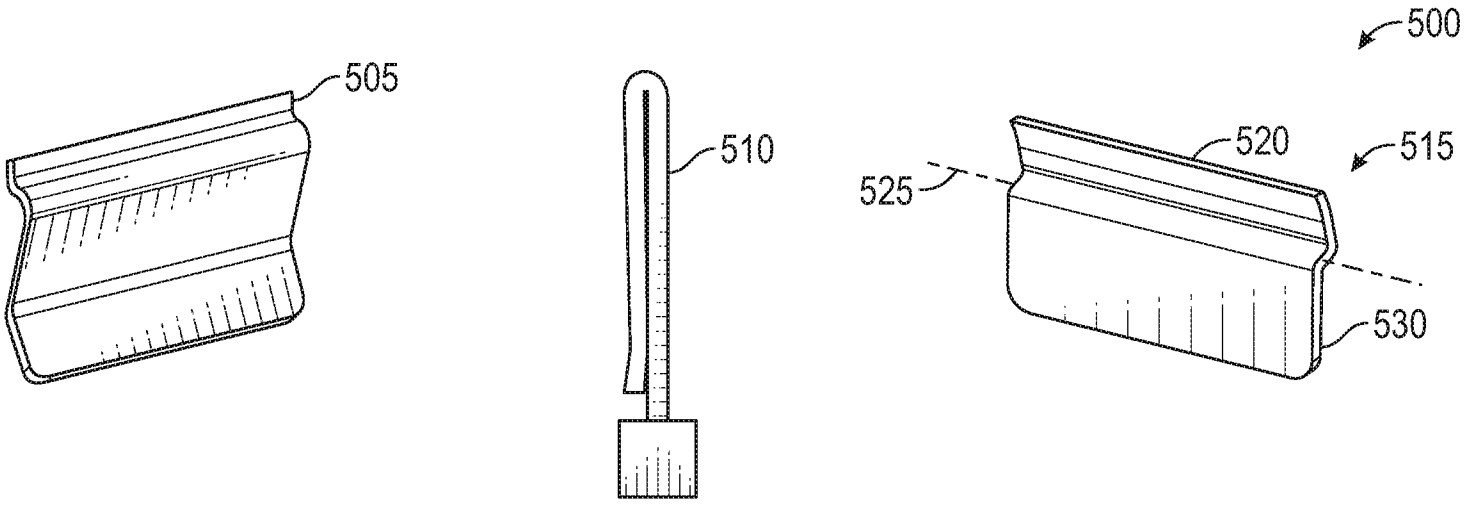
FIG. 5 illustrates exemplary implementations of biased members, according to one or more embodiments.

FIG. 5 illustrates exemplary implementations of biased members, according to one or more embodiments. The implementations of biased members illustrated in diagram 500 may be used in conjunction with other embodiments, such as in the tote-retaining apparatus depicted in FIG. 2.

The diagram 500 includes clips 505, 510 that are oriented in a downward direction. Stated another way, each of the clips 505, 510 engages an interior surface of a sidewall when the sidewall is slid upwardly. The clips 505, 510 may be constructed of a resilient material, such as spring steel. As shown, the clip 505 is wider than the clip 510. In some embodiments, the clip 510 is dimensioned to pass through an opening in the sidewall (e.g., a grommet) before engaging the sidewall.

The diagram 500 further includes a hinged clip 515 that is oriented in the downward direction. The hinged clip 515 may be spring-loaded. Pressing an upper portion 520 of the hinged clip 515 counters the spring biasing of the hinged clip 515. The hinged clip 515 rotates about a rotation axis 525, and a lower portion 530 of the hinged clip 515 moves away from the first surface. The sidewall of the collapsible tote may be inserted between the lower portion 530 and the first surface, and the upper portion 520 is released to engage the sidewall with the lower portion 530.

Although the clips 505, 510 and the hinged clip 515 are shown as downward-oriented, the clips 505, 510 and the hinged clip 515 may have different orientations suitable for engaging with the sidewall. For example, the clips 505, 510 and the hinged clip 515 may have an upward orientation, and may engage the sidewall when the sidewall is slid downwardly.

Figure 6:
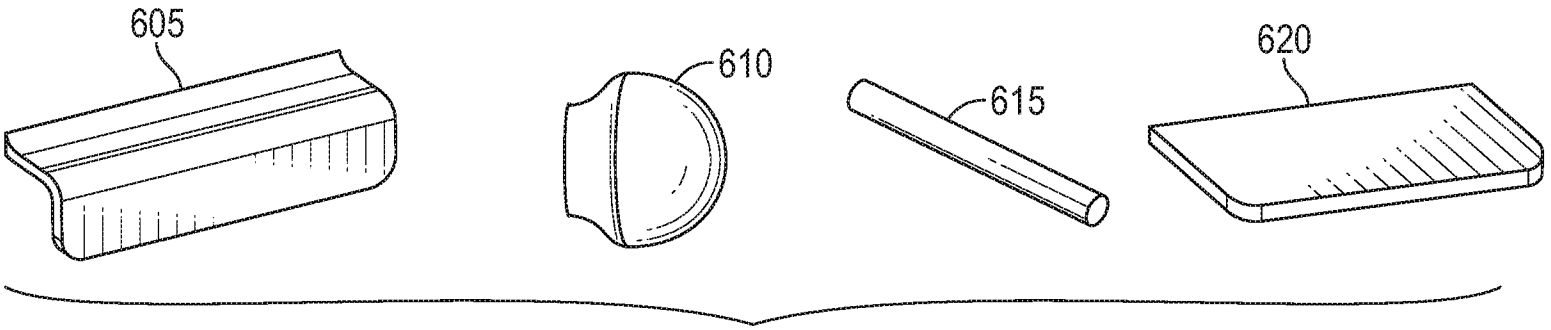
FIG. 6 illustrates exemplary implementations of hanger members, according to one or more embodiments.

FIG. 6 illustrates exemplary implementations of hanger members, according to one or more embodiments. The implementations of hanger members illustrated in diagram 600 may be used in conjunction with other embodiments, such as in the tote-retaining apparatus depicted in FIG. 2.

The diagram 600 includes a hook 605, a knob 610, a post 615, and a tab 620. Each of these, when projecting from the second surface of the tote-retaining apparatus, may engage a handle of the collapsible tote. The hook 605, the knob 610, the post 615, and the tab 620 may have any suitable dimensioning and orientation.

Figure 7:
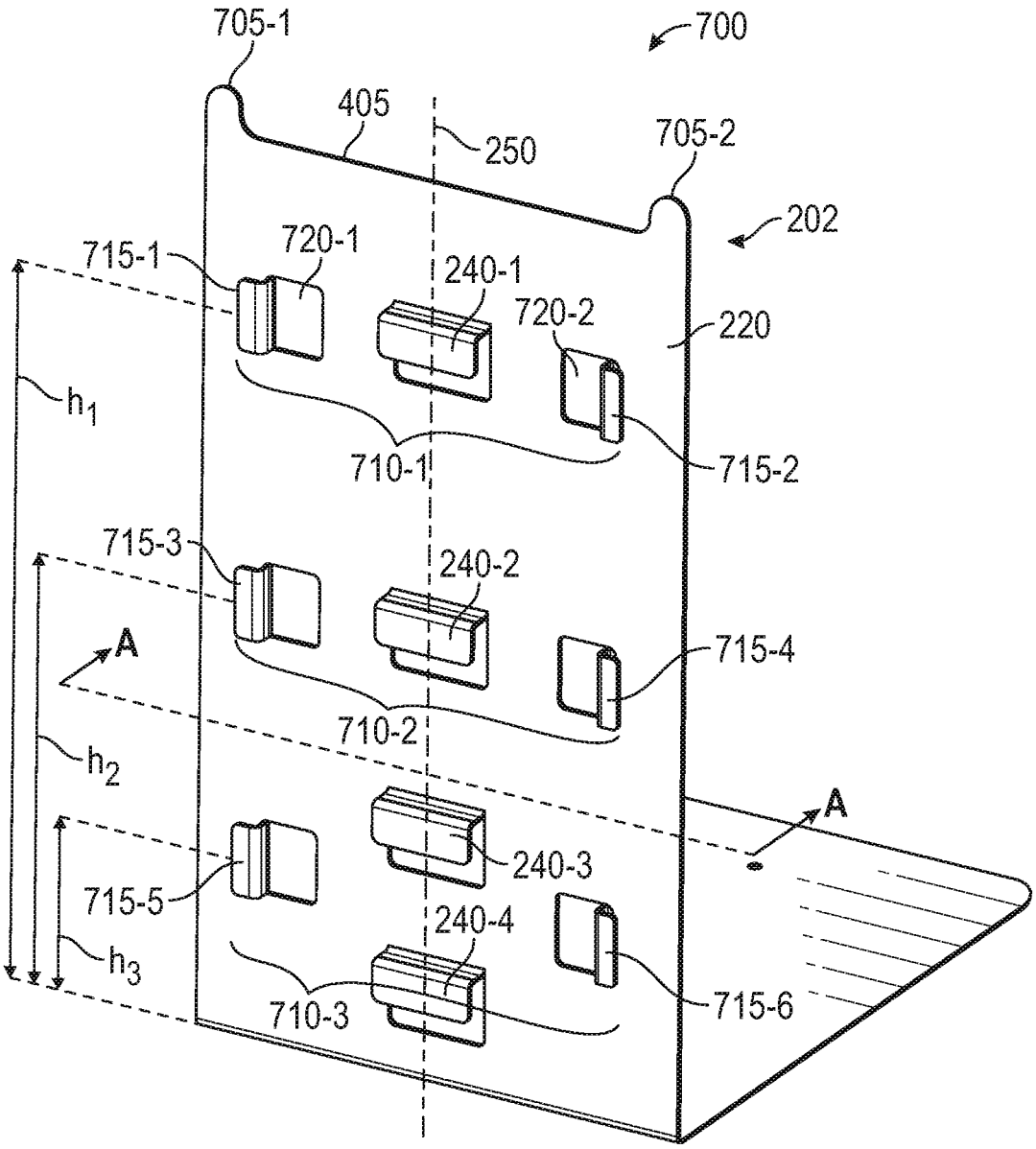
FIG. 7 is a diagram of an exemplary apparatus having multiple hooks as hanger members, according to one or more embodiments.
Figure 8B:
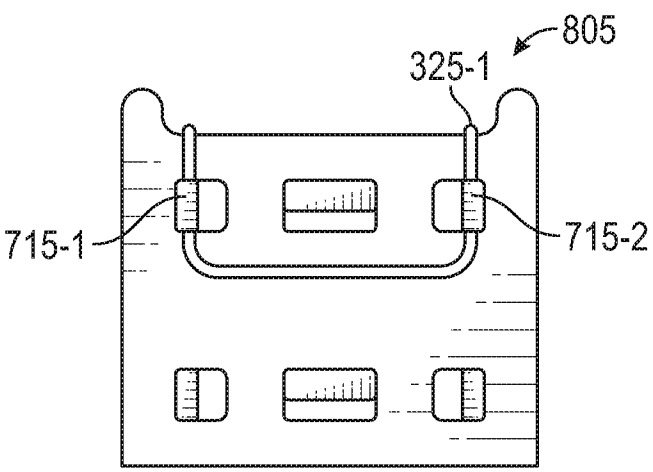
FIGS. 8A-8D illustrate engaging a handle of a collapsible tote with hanger members, according to one or more embodiments.
Figure 8A:
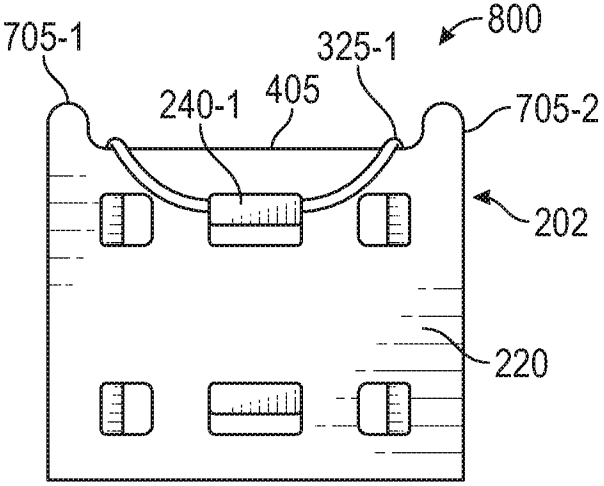
Figure 8D:
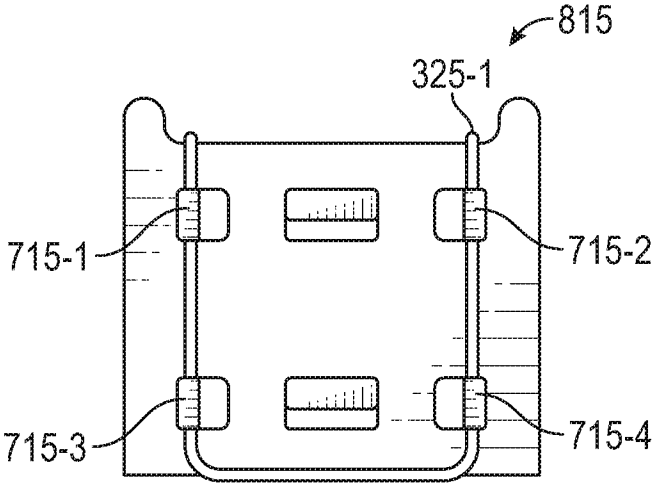
Figure 8C:
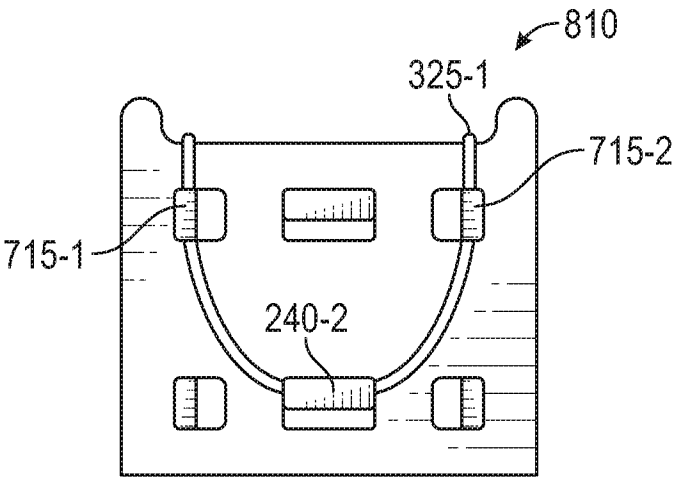

FIG. 7 is a diagram 700 of an exemplary apparatus having multiple hooks as hanger members, according to one or more embodiments. More specifically, the tote-retaining apparatus depicted in the diagram 700 comprises the hanger members 240-1, 240-2, 240-3, 240-4 arranged as a plurality of first hooks having downward-facing throats and distributed along a height of the wall member. The plurality of first hooks is arranged along the midline 250 of the wall member 202. As shown, the hanger member 240-1 is at a first height $h_1$, and the hanger member 240-2 is at a second height $h_2$ less than the first height $h_1$.

The one or more hanger members of the tote-retaining apparatus further comprise a plurality of second hooks 715-1, 715-2, 715-3, 715-4, 715-5, 715-6. The plurality of second hooks 715-1, 715-2, 715-3, 715-4, 715-5, 715-6 are arranged as one or more pairs 710-1, 710-2, 710-3 of second hooks. As shown, the pair 710-1 includes the second hooks 715-1, 715-2, the pair 710-2 includes the second hooks 715-3, 715-4, and the pair 710-3 includes the second hooks 715-5, 715-6. Each pair 710-1, 710-2, 710-3 is distributed on opposing sides of the midline 250 with a respective height along the second surface 220. As shown, the pair 710-1 is at the first height $h_1$, the pair 710-2 is at the second height $h_2$, and the pair 710-3 is at a third height $h_3$ less than the second height $h_2$. The second hooks of each pair 710-1, 710-2, 710-3 have laterally-facing throats.

The tote-retaining apparatus further comprises tabs 705-1, 705-2 formed at lateral edges of the top 405 of the wall member 202, which limit the lateral motion of the handle when extended over the top 405. Stated another way, the tabs 705-1, 705-2 are dimensioned and arranged to prevent the handle from sliding along the top 405 and sliding off of the wall member 202. Although the tabs 705-1, 705-2 are illustrated as being coplanar with the wall member 202, other arrangements suitable for limiting the motion of the handle are also contemplated.

FIGS. 8A-8D illustrate engaging the handle 325-1 of a collapsible tote with hanger members, according to one or more embodiments. The features illustrated in diagrams 800, 805, 810, 815 may be used in conjunction with other embodiments, such as in the tote-retaining apparatus depicted in FIG. 7. More specifically, the diagrams 800, 805, 810, 815 illustrate several possible configurations of the handle with portions of the tote-retaining apparatus of FIG. 7 above line A-A.

In the diagram 800, the handle 325-1 is engaged with the hanger member 240-1 (e.g., a hook with a downward-facing throat), and the handle 325-1 extends over the top 405 of the wall member 202 between the tabs 705-1, 705-2. In this way, the collapsible tote may be suspended beside the first surface (i.e., opposing the second surface 220) of the wall member 202. In the diagram 805, the handle 325-1 is engaged with the second hooks 715-1, 715-2 and extends over the top 405 of the wall member 202. In the diagram 810, the handle 325-1 is engaged with the hanger member 240-2 and with the second hooks 715-1, 715-2 and extends over the top 405 of the wall member 202. In the diagram 815, the handle 325-1 is engaged with second hooks 715-1, 715-2, 715-3, 715-4 and extends over the top 405 of the wall member 202.

Figure 9:
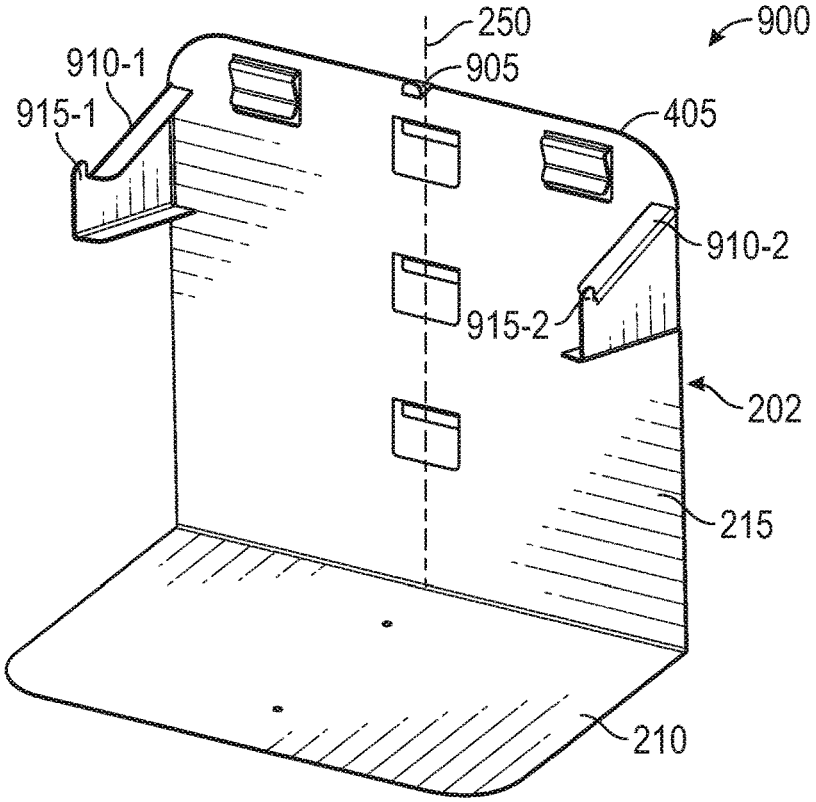
FIG. 9 is a diagram of an exemplary apparatus capable of retaining a collapsible tote and a single-use plastic bag, according to one or more embodiments.

FIG. 9 is a diagram 900 of an exemplary apparatus capable of retaining a collapsible tote and a single-use plastic bag, according to one or more embodiments. The features illustrated in the diagram 900 may be used in conjunction with other embodiments, such as with the tote-retaining apparatus of FIGS. 2 and 7.

In the diagram 900, the tote-retaining apparatus comprises one or more second engagement members projecting from the first surface 215. In some embodiments, the one or more second engagement members may be integrally formed with the wall member 202. In other embodiments, the one or more second engagement members may be separately formed and attached to the wall member 202 using any suitable means.

Figure 10A:
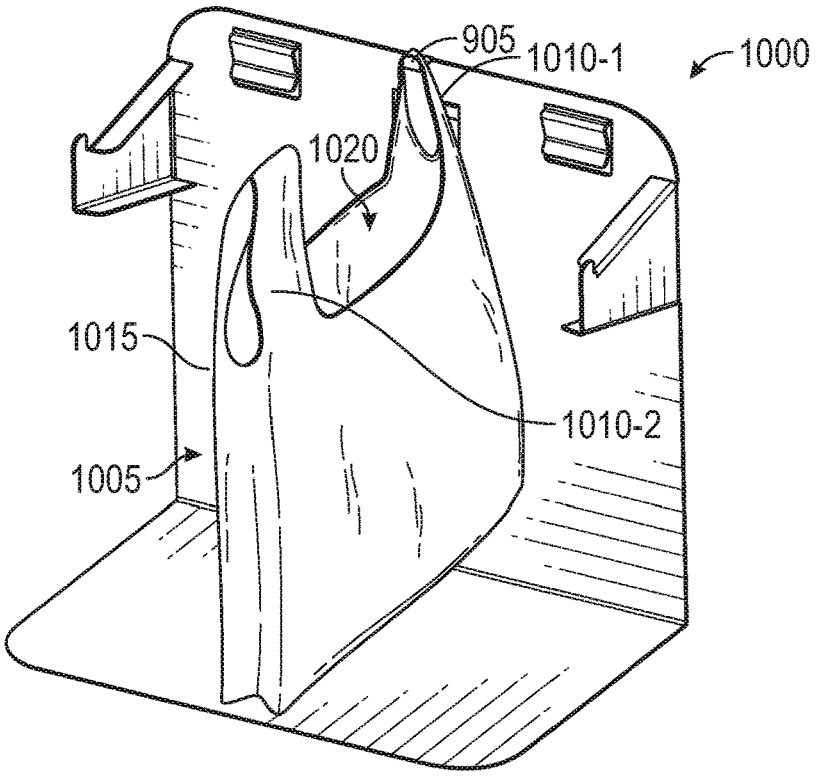
FIG. 10A, 10B illustrate engaging portions of a single-use plastic bag, according to one or more embodiments.

In some embodiments, the one or more second engagement members comprise a hook 905 extending from the first surface 215 near the top 405. The hook 905 is shown as being arranged at the midline 250 of the wall member 202 and having an upward orientation, but other arrangements and orientations are also contemplated. The hook 905 is dimensioned to removably engage a handle 1010-1 of a single-use plastic bag 1005, as illustrated in diagram 1000 of FIG. 10A. When the hook 905 is engaged with the handle 1010-1, the single-use plastic bag 1005 is suspended beside the first surface 215. In some cases, when the hook 905 is engaged with the handle 1010-1, a body 1015 of the single-use plastic bag 1005 may be positioned such that a main storage compartment 1020 is in an open configuration, easing the process of placing items into the main storage compartment 1020.

In some embodiments, the one or more second engagement members comprise arms 910-1, 910-2 arranged at lateral ends of the first surface 215. The arms 910-1, 910-2 extend from the first surface 215 with any suitable inclination. For example, the arms 910-1, 910-2 may be substantially horizontal (or parallel to the base portion 210) or may extend substantially perpendicular to the first surface 215 (e.g., based on an inclination of the first surface 215).

Figure 10B:
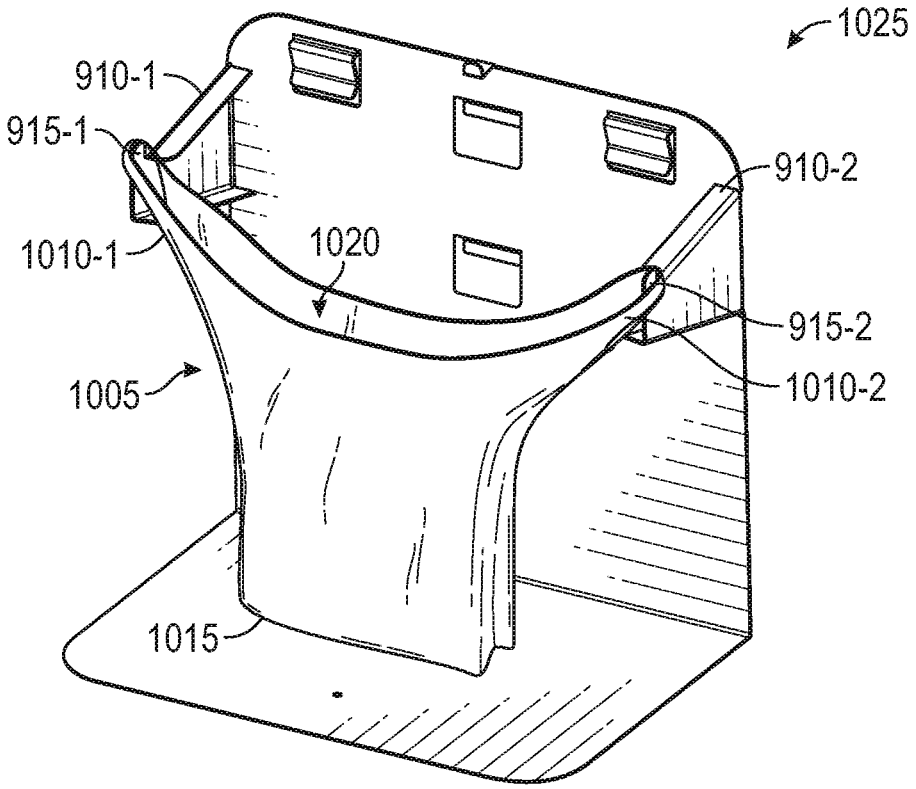

The arms 910-1, 910-2 are dimensioned to removably engage respective handles 1010-1, 1010-2 of the single-use plastic bag 1005, as illustrated in diagram 1025 of FIG. 10B. When the arms 910-1, 910-2 are engaged with the handles 1010-1, 1010-2, the single-use plastic bag 1005 is suspended beside the first surface 215. In some cases, when the arms 910-1, 910-2 are engaged with the handles 1010-1, 1010-2, the body 1015 of the single-use plastic bag 1005 may be positioned such that the main storage compartment 1020 is in an open configuration, easing the process of placing items into the main storage compartment 1020.

Each of the arms 910-1, 910-2 has a respective tab 915-1, 915-2 at its extent. The tabs 915-1, 915-2 limit the motion of the single-use plastic bag 1005 when engaged with the arms. Stated another way, the tabs 915-1, 915-2 are dimensioned and arranged to prevent the handles 1010-1, 1010-2 of the single-use plastic bag 1005 from sliding along the tops of the arms 910-1, 910-2 and sliding off of the arms 910-1, 910-2 entirely. Although the tabs 915-1, 915-2 are illustrated as being substantially coplanar with the respective arms 910-1, 910-2, other arrangements suitable for limiting the motion of the handles 1010-1, 1010-2 are also contemplated.

Figure 11:
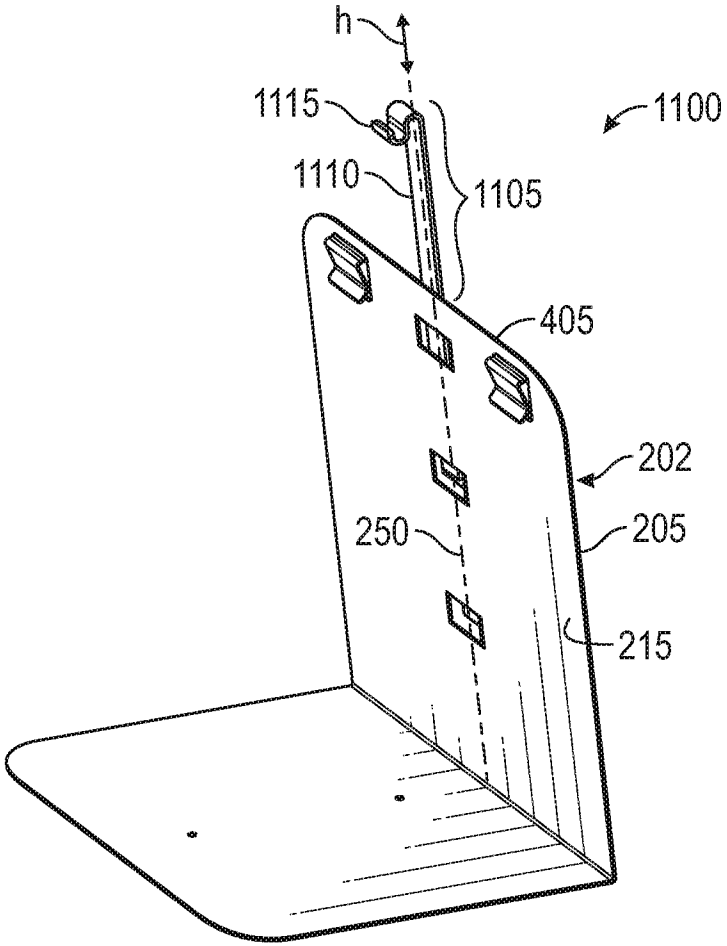
FIG. 11 is a diagram of an exemplary apparatus capable of adjusting a height of one or more engagement members, according to one or more embodiments.

FIG. 11 is a diagram 1100 of an exemplary apparatus capable of adjusting a height of one or more engagement members, according to one or more embodiments. The features illustrated in the diagram 1100 may be used in conjunction with other embodiments, such as with the tote-retaining apparatus of FIGS. 2, 7, and 9.

In the diagram 1100, the tote-retaining apparatus comprises an engagement assembly 1105 that engages one or more portions of a collapsible tote and/or a single-use plastic bag, and that is extendible in a vertical dimension. The engagement assembly 1105 comprises one or more second engagement members (as shown, a hook 1115) arranged and dimensioned to removably engage respective portions of the collapsible tote (and/or the single-use plastic bag), and an extension member 1110 connected with the one or more second engagement members. The extension member 1110 is adjustably connected with the wall member 202 to arrange the one or more second engagement members at heights h that are greater than a height of the wall member 202. In some embodiments, the extension member 1110 comprises an elongated member slidingly engaged in a groove or slot formed at the second surface (opposite the first surface 215) of the wall member 202. The extension member 1110 and the hook 1115 may be formed of any suitable material(s) for supporting the weight of the collapsible tote (and any items stored therein). In some embodiments, the extension member 1110 and the hook 1115 are formed of a same material as the wall member 202. Although not shown, the apparatus may further comprise a mechanism for retaining the elongated member with a desired height h.

In some embodiments, the elongated member has a longitudinal axis extending in parallel with the midline 250 of the wall member 202. The hook 1115 extends from an end of the elongated member, and has an upward-facing throat dimensioned to engage a handle of the collapsible tote (and/or the single-use plastic bag). The extendible nature of the engagement assembly 1105 may be beneficial to suspend different types of collapsible totes with different heights and/or different handle lengths, to suspend the collapsible tote at a desired height, and so forth.

Figure 12:
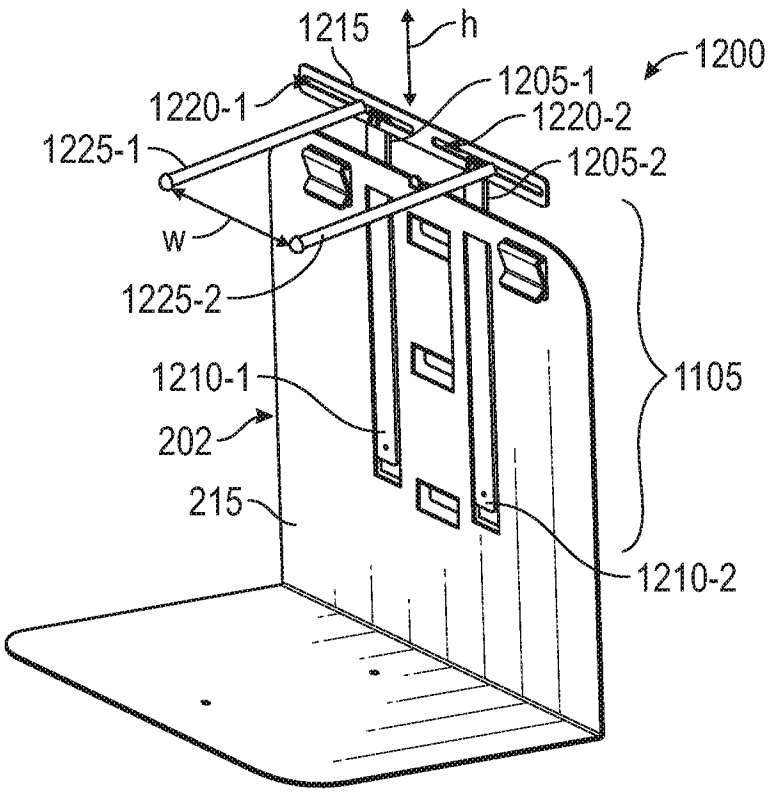
FIG. 12 is a diagram of an exemplary apparatus capable of adjusting height and width of engagement members, according to one or more embodiments.

FIG. 12 is a diagram 1200 of an exemplary apparatus capable of adjusting height and width of engagement members, according to one or more embodiments. The features illustrated in the diagram 1200 may be used in conjunction with other embodiments, such as with the tote-retaining apparatus of FIGS. 2, 7, and 9.

In the diagram 1200, the engagement assembly 1105 comprises two extension members 1205-1, 1205-2 adjustably connected with the wall member 202. Each of the extension members 1205-1, 1205-2 is received in a respective comprises an elongated member slidingly engaged in a respective groove or slot formed at the second surface (opposite the first surface 215) of the wall member 202. As shown, each of the extension members 1205-1, 1205-2 is exposed at a respective opening 1210-1, 1210-2 formed in the wall member 202. The extension members 1205-1, 1205-2 are adjustably connected with the wall member 202 to arrange the second engagement members at heights h that are greater than a height of the wall member 202. Although not shown, the apparatus may further comprise a mechanism for retaining the extension members 1205-1, 1205-2 with a desired height h.

The extension members 1205-1, 1205-2 is connected with a horizontal member 1215 having horizontal slots 1220-1, 1220-2 defined therethrough. The engagement assembly 1105 further comprises two second engagement members (implemented as posts 1225-1, 1225-2) that are slidingly engaged with the horizontal member 1215 at a respective horizontal slot 1220-1, 1220-2. In this way, the two second engagement members are adjustably connected with the extension members 1205-1, 1205-2 to control a width w between the two second engagement members. Although not shown, the engagement assembly 1105 may further comprise a mechanism for retaining the two second engagement members with a desired width w.

The extension members 1205-1, 1205-2, the horizontal member 1215, and the posts 1225-1, 1225-2 may be formed of any suitable material(s) for supporting the weight of the collapsible tote (and any items stored therein). In some embodiments, the extension members 1205-1, 1205-2, the horizontal member 1215, and the posts 1225-1, 1225-2 are formed of a same material as the wall member 202.

The extendible nature of the engagement assembly 1105 may be beneficial to suspend different types of collapsible totes with different dimensioning (heights and/or widths), to suspend collapsible totes with different handle lengths and/or handle spacing, to suspend the collapsible tote with a desired height, to provide a desired degree of opening the main storage compartment of the collapsible tote, and so forth.

Figure 13:
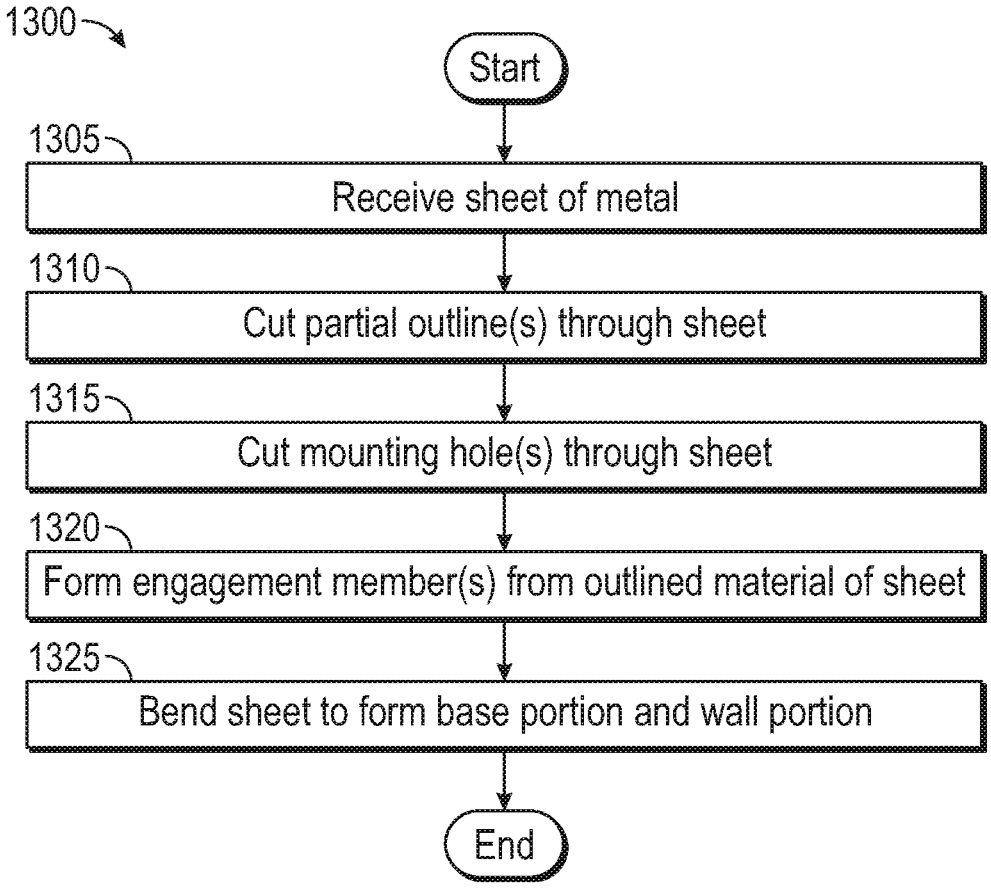
FIG. 13 is an exemplary method of fabricating a tote-retaining apparatus, according to one or more embodiments.

FIG. 13 is an exemplary method 1300 of fabricating a tote-retaining apparatus, according to one or more embodiments. The method 1300 may be used in conjunction with other embodiments, such as fabricating the tote-retaining apparatus of FIGS. 2, 7, 9, 11, and 12.

The method 1300 begins at block 1305, where a sheet of metal is received. Some non-limiting examples of the type of metal include spring steel and aluminum. At block 1310, one or more partial outlines are cut through the sheet. At block 1315, one or more mounting holes are cut through the sheet. The cutting operations of blocks 1310, 1315 may be performed using any suitable cutting tool. In some embodiments, the cutting operation is performed by a laser cutter.

Figure 14C:
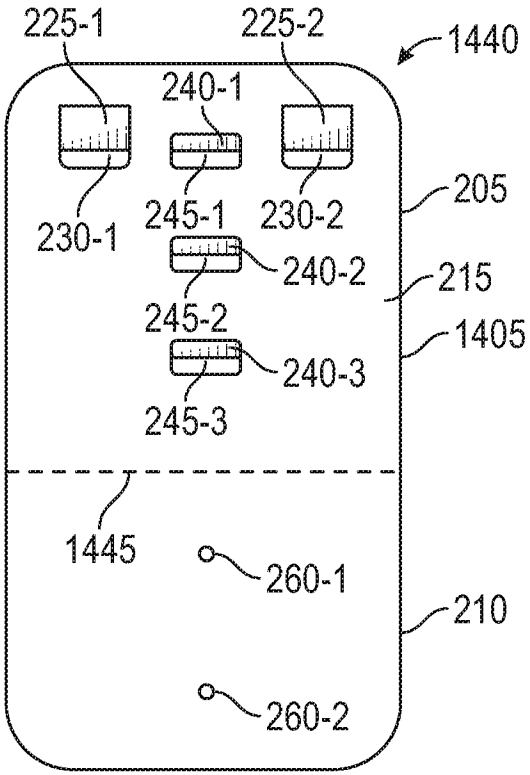
FIGS. 14A-14C illustrate exemplary stages of fabricating a tote-retaining apparatus, according to one or more embodiments.
Figure 14B:
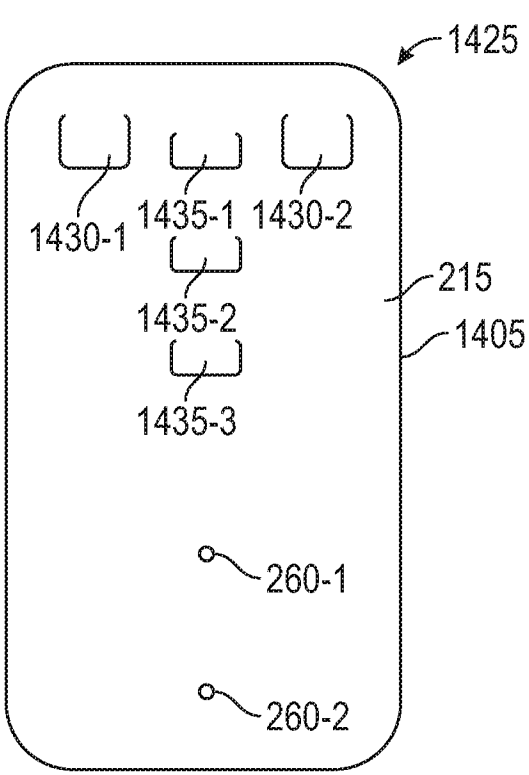
Figure 14A:
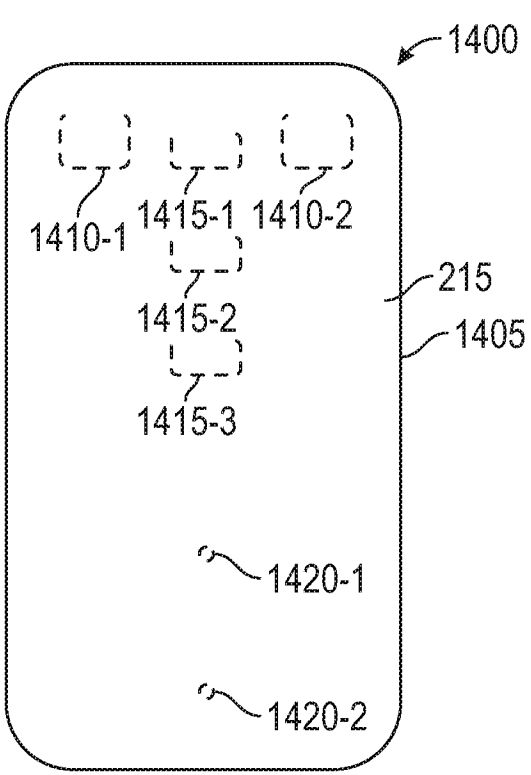

Referring also to FIG. 14A, in which diagram 1400 illustrates a first stage of fabricating the tote-retaining apparatus, a plurality of partial outlines 1410-1, 1410-2, 1415-1, 1415-2, 1415-3 and a plurality of outlines 1420-1, 1420-2 are illustrated relative to a sheet 1405 of metal. Corresponding to the implementation of the tote-retaining apparatus of FIG. 2, the partial outlines 1410-1, 1410-2 correspond to biased members to be formed at the first surface 215, and the partial outlines 1415-1, 1415-2, 1415-3 correspond to hanger members to be formed at the second surface (opposite the first surface 215). The plurality of outlines 1420-1, 1420-2 correspond to mounting holes for the tote-retaining apparatus (e.g., openings that are each dimensioned to receive a threaded fastener therethrough).

At block 1320, one or more engagement members are formed from the outlined material of the sheet 1405. In some embodiments, the one or more engagement members comprise one or more biased members at the first surface 215 and/or one or more hanger members. Referring also to FIGS. 14B and 14C, in which diagrams 1425, 1440 respectively illustrate second and third stages of fabricating the tote-retaining apparatus, the cutting operations define outlined material 1430-1, 1430-2 that is used to form the biased members 225-1, 225-2, outlined material 1435-1, 1435-2,

1435-3 that is used to form the hanger members 240-1, 240-2, 240-3, and openings 260-1, 260-2 that are used as mounting holes.

The one or more engagement members may be formed using any suitable techniques. In some embodiments, a forming die is used to bend (or otherwise deform) the outlined material 1430-1, 1430-2, 1435-1, 1435-2, 1435-3 into the desired shapes. In some embodiments, forming the one or more engagement members causes the openings 230-1, 230-2, 245-1, 245-2, 245-3 to be defined in the sheet 1405.

At block 1325, the sheet is bent to form a base portion and a wall portion. Referring also to FIG. 14C, the sheet 1405 is bent along a bend axis 1445 to define the base portion 210 and the wall portion 205. The sheet 1405 may be bent to provide any suitable relative inclination between the base portion 210 and the wall portion 205. In some embodiments, a forming die is used to bend the sheet 1405. The method 1300 ends following completion of block 1325.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the preceding, reference is made to embodiments presented in this disclosure. However, the scope of the present disclosure is not limited to specific described embodiments. Instead, any combination of the features and elements described herein, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the FIGS. illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the FIGS. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. An apparatus for retaining a collapsible tote, the apparatus comprising:

a wall member formed in a sheet of metal; and one or more engagement members projecting from one or more surfaces of the wall member, wherein the one or more engagement members are formed from the sheet, wherein the one or more engagement members are configured to removably engage respective portions of the collapsible tote, thereby suspending the collapsible tote beside a first surface of the one or more surfaces, wherein the one or more engagement members comprise:

one or more biased members projecting from the first surface, the one or more biased members configured to engage an interior surface of a sidewall of the collapsible tote, and wherein the wall member is inclined such that, when the collapsible tote is suspended beside the first surface, the collapsible tote is gravitationally urged toward an uncollapsed configuration.

2. The apparatus of claim 1, wherein the first surface is inclined between seven (7) degrees and thirty (30) degrees less than a vertical orientation.

3. The apparatus of claim 1, wherein the one or more biased members comprise:

a plurality of clips arranged as one or more pairs of clips, wherein each pair of the one or more pairs of clips has a respective height along the first surface, and wherein, for each pair of the one or more pairs, the clips of the pair are configured to engage the interior surface of the sidewall when the sidewall is slid between the first surface and the clips of the pair.

4. The apparatus of claim 3, wherein, for each pair of the one or more pairs, the clips of the pair are configured to engage the interior surface of the sidewall when the sidewall is slid upwardly.

5. The apparatus of claim 3, wherein the clips of each pair of the one or more pairs of cups is distributed on opposing sides of a midline of the wall member.

6. The apparatus of claim 1, further comprising:

an engagement assembly comprising:

one or more second engagement members arranged and dimensioned to removably engage respective portions of the collapsible tote; and an extension member connected with the one or more second engagement members, wherein the extension member is adjustably connected with the wall member to arrange the one or more second engagement members at heights greater than a height of the wall member.

7. The apparatus of claim 6, wherein the one or more second engagement members comprise:

two second engagement members adjustably connected with the extension member to control a width between the two second engagement members.

8. The apparatus of claim 1, further comprising:

one or more second engagement members projecting from the first surface, the one or more second engagement members arranged and dimensioned to removably engage respective portions of a single-use plastic bag, thereby suspending the single-use plastic bag beside the first surface.

9. The apparatus of claim 1, further comprising:

a base portion formed from the sheet, wherein the base portion and the wall member are formed by bending the sheet.

10. The apparatus of claim 9, wherein the base portion and the wall member are formed by bending the sheet along a bend axis.

11. The apparatus of claim 1, wherein the one or more engagement members are formed using a forming die to bend the sheet.

12. An apparatus for retaining a collapsible tote, the apparatus comprising:

a wall member; and one or more engagement members projecting from one or more surfaces of the wall member, wherein the one or more engagement members are configured to removably engage respective portions of the collapsible tote, thereby suspending the collapsible tote beside a first surface of the one or more surfaces, wherein the one or more engagement members comprise:

one or more hanger members at a second surface of the wall member opposing the first surface, the one or more hanger members configured to engage a handle of the collapsible tote, wherein the wall member is inclined such that, when the collapsible tote is suspended beside the first surface, the collapsible tote is gravitationally urged toward an uncollapsed configuration.

13. The apparatus of claim 12, wherein the handle of the collapsible tote, when engaged by the one or more hanger members, extends over a top of the wall member.

14. The apparatus of claim 12, wherein the one or more hanger members comprise either hooks, knobs, posts, or tabs that project outwardly from the second surface.

15. The apparatus of claim 12, wherein the one or more hanger members comprise:

a plurality of first hooks having downward-facing throats and distributed along a height of the wall member.

16. The apparatus of claim 15, wherein the plurality of first hooks are arranged along a midline of the wall member, and wherein the one or more hanger members further comprise:

a plurality of second hooks arranged as one or more pairs of second hooks, wherein the hooks of each pair of the one or more pairs of second hooks is distributed on opposing sides of the midline with a respective height along the second surface, and wherein the second hooks of each pair have laterally-facing throats.

17. An apparatus for retaining a reusable tote, the apparatus comprising:

a wall member defining a first surface and an opposing second surface;

one or more biased members extending from the first surface, the one or more biased members configured to engage an interior surface of a sidewall of the reusable tote, wherein engaging the interior surface with the one or more biased members suspends the reusable tote beside the first surface, wherein the one or more biased members comprise:

a plurality of clips arranged as one or more pairs of clips, wherein each pair of the one or more pairs of clips has a respective height along the first surface, wherein the clips of each pair are configured to engage the interior surface of the sidewall when the sidewall is slid upwardly between the first surface and the clips of the pair; and one or more hanger members extending from the second surface, the one or more hanger members configured to engage a handle of the reusable tote that is connected with the sidewall, wherein engaging the handle of the reusable tote with the one or more hanger members suspends the reusable tote beside the first surface.

18. The apparatus of claim 17, wherein one or both of: (i) the one or more biased members, and (ii) the one or more hanger members are integrally formed with the wall member.

19. The apparatus of claim 17, wherein the wall member is inclined such that, when the reusable tote is suspended beside the first surface, the reusable tote is gravitationally urged toward an uncollapsed configuration.

20. The apparatus of claim 17, wherein the one or more hanger members comprise:

a plurality of first hooks having downward-facing throats and distributed along a height of the wall member, wherein the plurality of first hooks are arranged along a midline of the wall member, and wherein the clips of each pair of the one or more pairs of clips is distributed on opposing sides of the midline.

* * * * *